US008453547B2

(12) United States Patent
Meyer et al.

(10) Patent No.: US 8,453,547 B2
(45) Date of Patent: Jun. 4, 2013

(54) METHOD AND DEVICE FOR TRIMMING AT LEAST ONE SIDE EDGE OF A BOUND PRINTED PRODUCT

(75) Inventors: Hanspeter Meyer, Huettwilen Tg (CH); Heinrich-Tito Mayer, Eschlikon (CH)

(73) Assignee: Mueller Martini Holding AG, Hergiswil (CH)

( * ) Notice: Subject to any disclaimer, the term of this patent is extended or adjusted under 35 U.S.C. 154(b) by 323 days.

(21) Appl. No.: 12/507,511

(22) Filed: Jul. 22, 2009

(65) Prior Publication Data

US 2010/0018368 A1 Jan. 28, 2010

(30) Foreign Application Priority Data

Jul. 24, 2008 (EP) ..... 08161112

(51) Int. Cl.
*B26D 7/02* (2006.01)
*B26D 5/08* (2006.01)

(52) U.S. Cl.
USPC ..... 83/13; 83/23; 83/98; 83/99; 83/151; 83/465; 83/546

(58) Field of Classification Search
USPC ..... 83/13, 23, 277, 422, 267, 436, 155, 83/9.51, 924, 151, 78, 452, 546, 98, 934, 83/99, 109, 149, 162–165, 904, 917
See application file for complete search history.

(56) References Cited

U.S. PATENT DOCUMENTS

| | | | | |
|---|---|---|---|---|
| 1,485,886 | A * | 3/1924 | Russell | 83/658 |
| 2,562,267 | A * | 7/1951 | Granberg | 83/138 |
| 2,809,696 | A * | 10/1957 | Miller | 83/438 |
| 2,881,834 | A * | 4/1959 | Thumim | 83/437.4 |
| 4,527,451 | A * | 7/1985 | Davis | 81/9.51 |
| 5,015,223 | A * | 5/1991 | Boeckmann | 493/194 |
| 7,765,907 | B2 * | 8/2010 | Meyer | 83/99 |
| 2004/0112195 | A1 * | 6/2004 | Lorenzi | 83/546 |
| 2005/0016345 | A1 * | 1/2005 | Lorenzi | 83/151 |
| 2006/0112803 | A1 * | 6/2006 | Vossen | 83/452 |
| 2009/0165616 | A1 * | 7/2009 | Rathert | 83/155 |

FOREIGN PATENT DOCUMENTS

| | | | |
|---|---|---|---|
| DE | 20 22 951 | A1 | 1/1971 |
| DE | 34 39 618 | A1 | 4/1986 |
| EP | 0 105 748 | A | 4/1984 |
| EP | 1 225 05 | A | 7/2002 |
| GB | 935 863 | A | 9/1963 |

OTHER PUBLICATIONS

European Search Report issued in Priority Application No. 08161112.1, Dated: Jan. 21, 2009.

* cited by examiner

*Primary Examiner* — Ghassem Alie
(74) *Attorney, Agent, or Firm* — Venable LLP; Robert Kinberg

(57) ABSTRACT

A device for trimming at least one side edge of a bound printed product including a trimming table to receive the printed product and a press die arranged to press the printed product against the trimming table. The press die is operative to rise and fall with respect to the trimming table and the press die includes an elastic surface in a region approximately near the side edge of the print product. The elastic surface is operable to expand in a direction approximately transverse to the pressing direction. The device also includes a trimming knife positioned to trim the side edge. The trimming knife is operable to move between a starting position away from the trimming table and an ending position at the trimming table. The device also includes counter blade or a cutting bar mounted to limit a cutting stroke of the trimming knife.

10 Claims, 3 Drawing Sheets

METHOD AND DEVICE FOR TRIMMING AT LEAST ONE SIDE EDGE OF A BOUND PRINTED PRODUCT

CROSS-REFERENCE TO RELATED APPLICATION

This application claims the priority of European Patent Application No. 08161112.1, filed on Jul. 24, 2008, the subject matter of which is incorporated herein by reference.

BACKGROUND OF THE INVENTION

The invention relate to a method and a device for trimming at least one side edge of a bound printed product such as book blocks, books, brochures, magazines, or similar flat objects. The printed product is positioned on a trimming table and supplied in a position ready for trimming. The printed product is held in place during the trimming, realized with a driven trimming knife, by a press die that can be raised and lowered.

Devices of the aforementioned type are known as three-way trimmers or trimmers. The devices are used for trimming along three side edges of bound printed products. To achieve the most precise cut possible, the printed products are first aligned along the spine and the side edges. The printed products are then clamped in between a trimming table and the lowered press die while pressure is applied to the flat sides. The required pressing force must at least be high enough so that during the trimming operation the printed product cannot move, relative to itself or relative to the press die. The distribution of the pressing force over the surface area of the printed product is furthermore selected such that the specific pressure exerted onto the printed product is higher in the side edge areas to be trimmed than in the remaining regions. This can be achieved by selecting a greater thickness for the edge regions of the press die than for the other locations.

It has turned out, however, in practical operations the surfaces of some printed products, which are not clamped down, can be uneven. The unevenness may be the result of waviness caused by a movement direction transverse to the bound edge of the printed product for the printed sheets, which are bound into a printed product. The unevenness may also be the result of folds generated along the side edge to be trimmed, air inclusions between the pages, and for other reasons. The top surface of the printed products positioned on the trimming table may therefore assume a concave shape. If several stacked copies are trimmed simultaneously, this defect may be cumulative on the surface of the uppermost copy.

At the start of the pressing operation, the first contact between the printed product and the press die therefore occurs in the edge regions, causing the printed products to be secured in this position between press die and the trimming table. This secured position prevents the printed product region facing the press die from moving, relative to the press die surface, during the build-up of the pressing force. The cover areas located between these contact locations are thus somewhat longer than the corresponding, straight-line section of the press die. As a result, a wave respectively may form in the cover during the continued pressing, wherein this wave may move from the outside toward the inside until it meets the wave moving from the opposite side toward the inside. The cover is consequently compressed or creased and is pressed down in this state by the press die. Permanent squeezing folds are thus generated on the top pages of the cover and the content, which can lead to reduced quality or to rejected products.

SUMMARY

It is therefore an object of the present invention to provide a generic method and a corresponding device, which prevents the forming of creases during the pressing operation on the side of the printed product that is facing the press die.

The above and other objects are accomplished according to one aspect of the invention, wherein there is provided a method for trimming at least one side edge of a bound printed product, the method comprising: supplying the printed product to a trimming table; positioning the printed product on the trimming table in a position ready for trimming; advancing a press die toward the table; contacting the printed product with a surface of the press die; exerting a stretching force onto an upper sheet of the printed product by the surface of the press die; holding the printed product in place with the press die; and trimming the printed product with a driven trimming knife.

According to a further aspect of the invention, there is provided a device for trimming at least one side edge of a bound printed product, the device comprising: a trimming table to receive the printed product in a position ready for trimming; a press die arranged to press the printed product against the trimming table during a trimming operation in a pressing direction, the press die being operative to rise and fall with respect to the trimming table, the press die comprising an elastic surface in a region approximately near the side edge of the print product, the elastic surface operable to expand in a direction approximately transverse to the pressing direction; a trimming knife positioned to trim the side edge, the trimming knife operable to move between a starting position away from the trimming table and an ending position at the trimming table; and a counter blade or a cutting bar mounted to limit a cutting stroke of the trimming knife.

BRIEF DESCRIPTION OF THE DRAWINGS

The present invention will be more readily understood from the following detailed description when read in conjunction with the accompanying drawings, in which.

DETAILED DESCRIPTION

Figure 1:
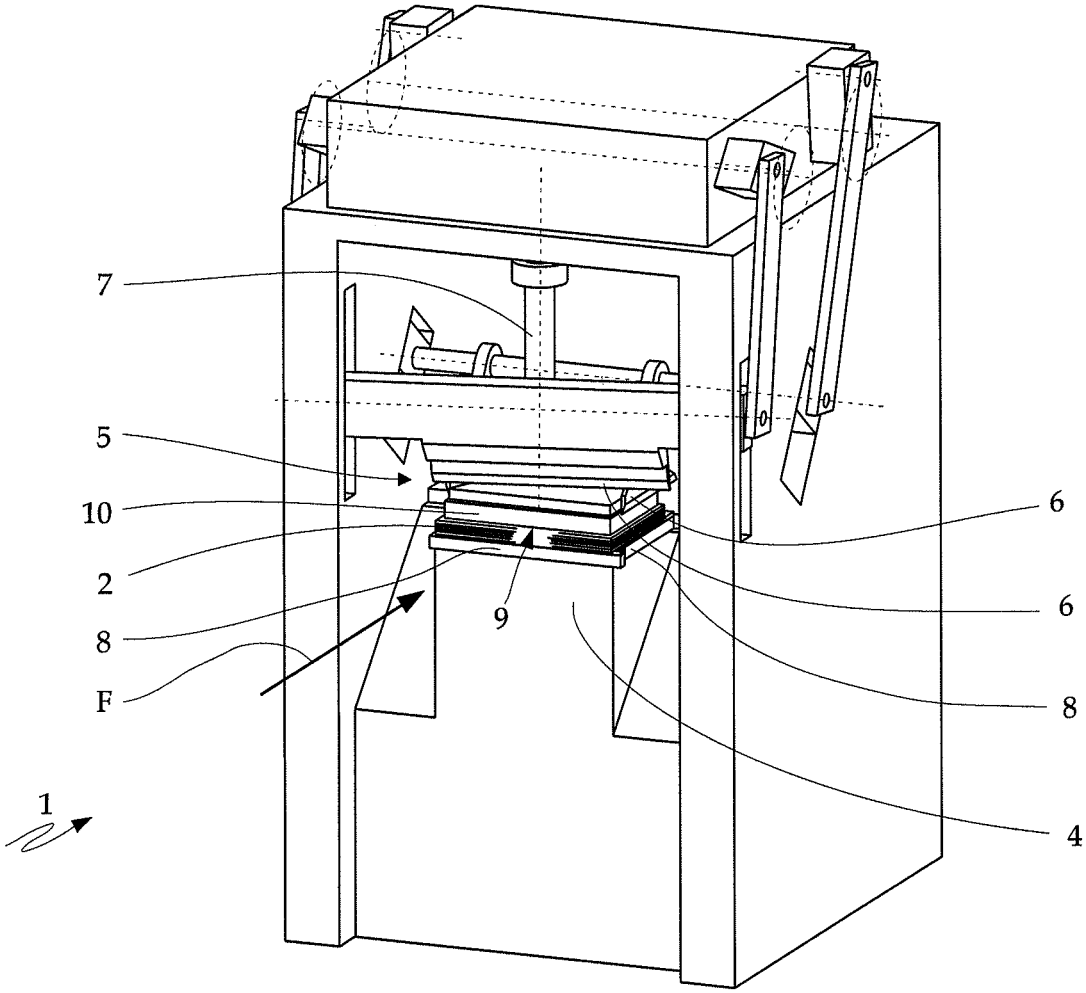
FIG. 1 is a simplified three-dimensional view of a trimming device.
Figure 3:
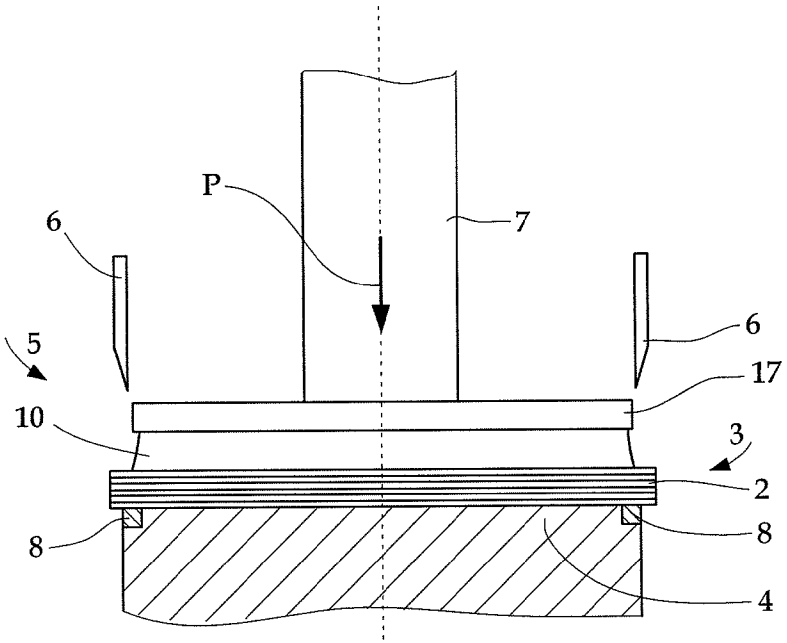
FIG. 3 is the device according to FIG. 2, with the printed product pressed down.
Figure 2:
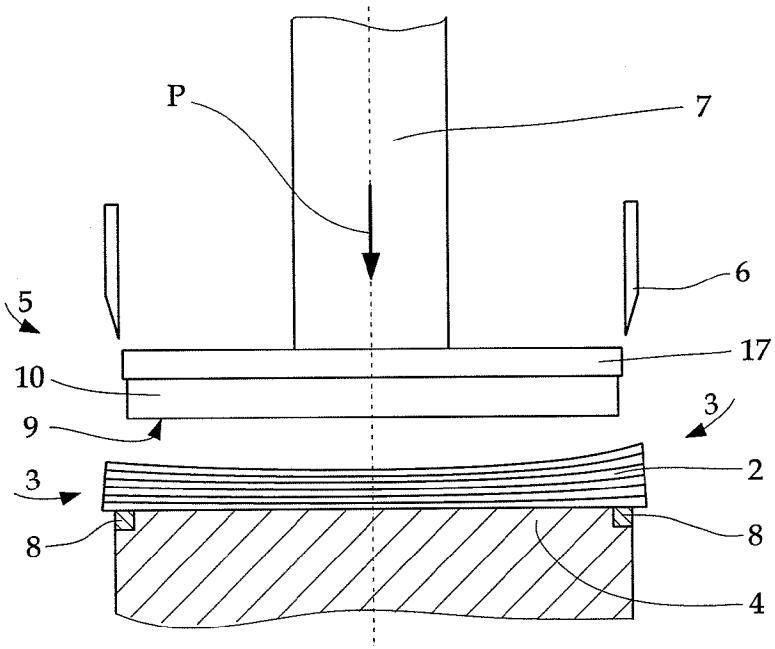
FIG. 2 is a partial sectional view of a device according to the invention as seen in the conveying direction, wherein the printed product is not yet pressed down.

As shown in FIGS. 1-3, the trimming device 1 is intended for trimming at least one side edge 3 of bound printed products 2 or similar products such as book blocks, books, brochures, magazines, or similar flat objects. The printed product 2 is bound primarily along the spine and is supplied in a conveying direction F to the trimming device 1. The printed products are supplied either individually or in stacks and positioned horizontal. The device trims the printed product along its three exposed side edges 3.

The trimming device 1 includes a trimming table 4. The printed product is supplied to the trimming device 1 in a position ready for trimming. A press die 5 may be lifted up and down in order to press the printed product against the trimming table 4, at least during the trimming operation. A trimming knife 6 may be driven from a starting position toward the trimming table 4 to an end position and back again. A counter blade or a cutting bar 8 may limit the cutting stroke of the trimming knife 6.

On top of the press die 5, a support 17 may be provided. The support 17 may be connected to a guide rod 7. The guide rod 7 may be drive-connected in a pressing direction P to a cam drive, an electric servo drive, a pneumatic drive, or a hydraulic drive. The press die 5 furthermore may have an elastic surface 9 that faces the printed product to be trimmed. The elastic surface 9 may extend at least in the area near a cutting side edge 3 approximately transverse to the pressing direction P. The elastic surface may be connected to a layer 10 and the layer 10 may be connected to the support 17. The configuration of the layer 10 causes the expansion in the direction transverse to the pressing direction P. This expansion may be the result of the force-buildup in pressing direction P, which causes the expansion transverse to the pressing direction P. As a result, the surface of the printed product facing the press die 5 is stretched, thereby preventing the formation of folds on the printed product surface. The surface 9 of the press die 5 may be embodied with interruptions at least in some areas.

Figure 4:
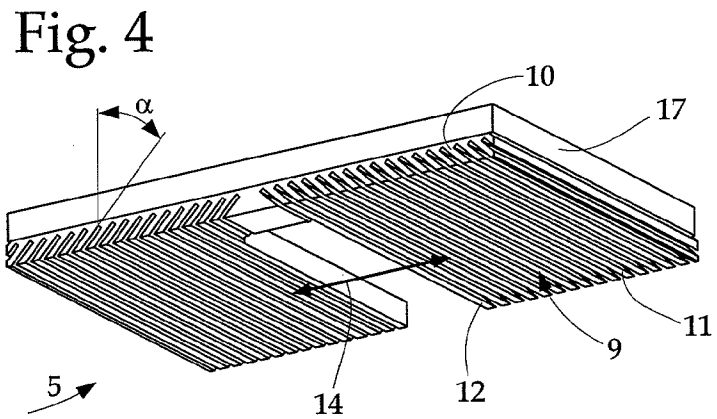
FIG. 4 is a simplified, three-dimensional view of a first embodiment of a press die, as seen from below.

According to an embodiment shown in FIG. 4, the surface 9 of the press die 5 is arranged on support elements 11. The support elements 11 project at an acute angle $\alpha$ to the pressing direction P. The ends 12 of the support elements 11 face the printed product and may be deflected in the expansion direction 14 of the surface 9. Even though the device may be embodied for the stretching in expansion direction 14 which is along the side edges 3 that are positioned opposite the bound back of the good to be trimmed, the device may also be used for the stretching in expansion direction 13 transverse to the bound back of the good to be trimmed.

Figure 6:
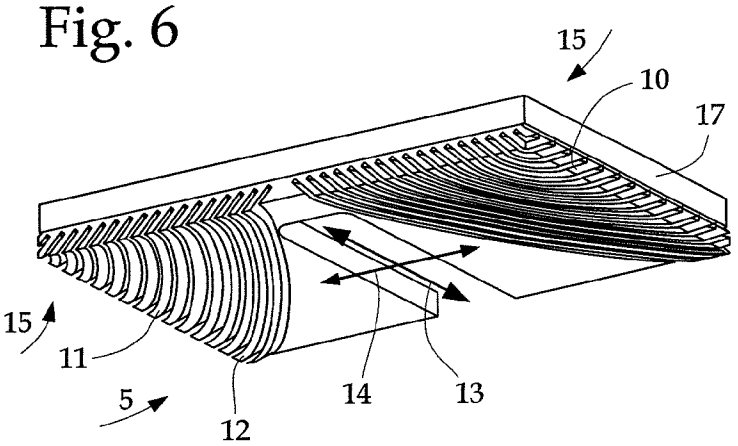
FIG. 6 is a simplified, three-dimensional view of a third embodiment of a press die, as seen from below.
Figure 5:
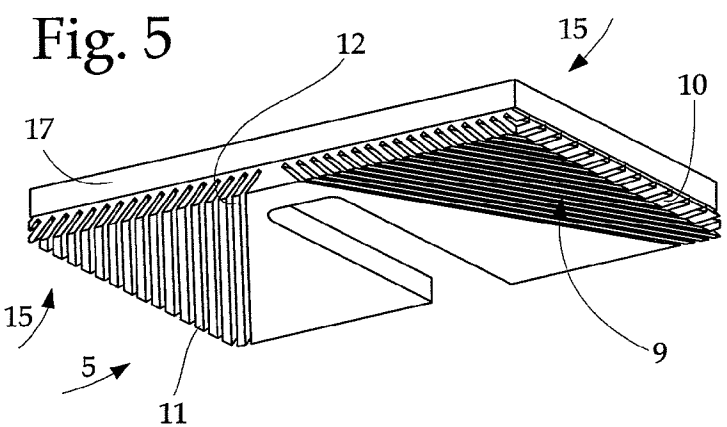
FIG. 5 is a simplified, three-dimensional view of a second embodiment of a press die as seen from below.

As shown in FIGS. 5 and 6, the support elements 11 may be embodied such that a stress in the pressing direction P causes the support elements 11 to be effective toward the edges 15 of the printed product. The support elements 11 are respectively diagonal to the side edges 3 of the printed product so as to be effective toward the edges 15. The support elements 11 shown in the embodiments of FIGS. 4 to 7 have a strip-type design. Embodiments of the invention include the support elements 11 embodied as continuous strips that extend from one edge region to the other of the press die 5 or embodied as several short, successively arranged strips.

According to a different embodiment, shown in FIG. 6, the strip-type support elements 11 have a curved shape. In this way, the rate of springiness of the layer 10 may be influenced or adapted to the characteristics of the printed product. The spaces between the support elements 11 are shown as clearance spaces in FIGS. 4 to 7. These spaces may be filled with an elastic material or the support elements 11 may be embedded in an elastic material, for example to adapt the springiness rate of the layer 10 to the characteristics of the printed product.

Figure 7:
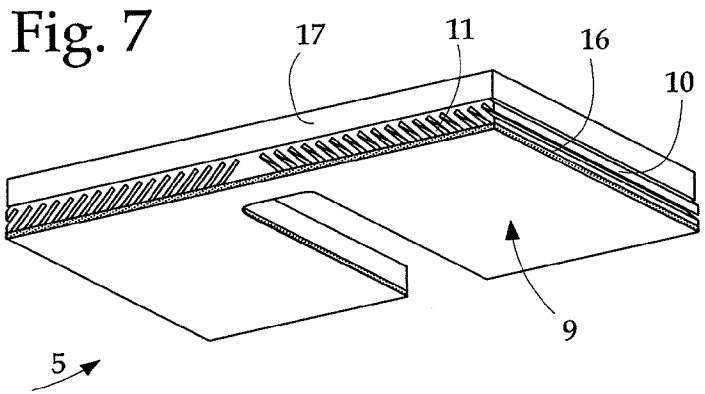
FIG. 7 is a simplified, three-dimensional view of a fourth embodiment of the press die, as seen from below.

According to an embodiment shown in FIG. 7, the surface 9 of the press die 5 is embodied as a panel 16 that may be elastically deformed at least in some sections. Embodiments of the invention are not limited to a trimming device which realizes the trimming of all three side edges 3 in the same position. Embodiments of the invention may also include a trimming device for realizing trimming along only one or two side edges in the same trimming position and may include trimming devices with trimming knives 6 that cut against a counter blade or against cutting bars 8. Embodiments of the invention may consequently relate to nearly full-surface press dies 5, as well as small, strip-type press dies 5.

It will be understood that the above description of the present invention is susceptible to various modifications, changes and adaptations, and the same are intended to be comprehended within the meaning and range of equivalents of the appended claims.

What is claimed is:

1. A method for trimming at least one side edge of a bound printed product, the method comprising:

supplying the printed product to a trimming table;

positioning the printed product on the trimming table in a position ready for trimming;

advancing a press die toward the table in a pressing direction;

contacting the printed product with a surface of the press die;

exerting a stretching force onto an upper sheet of the printed product by the surface of the press die, wherein the press die includes support elements and an elastic surface arranged on the support elements, wherein the support elements and elastic surface together include two sections with an opening between the two sections, wherein the support elements project at an acute angle to the pressing direction, with the support elements on opposite sides of the opening projecting away from each other so that the elastic surface of one section is expandable in a direction away from the elastic surface of the other section in order to exert the stretching force onto the upper sheet of the printed product;

holding the printed product in place with the press die; and trimming the printed product with a driven trimming knife.

2. A device for trimming at least one side edge of a bound printed product, the device comprising:

a trimming table to receive the printed product in a position ready for trimming;

a press die arranged to press the printed product against the trimming table during a trimming operation in a pressing direction, the press die being operative to rise and fall with respect to the trimming table, the press die comprising, at least in a region approximately near the side edge of the print product, support elements and an elastic surface arranged on the support elements and being operable to expand in a direction approximately transverse to the pressing direction, wherein the support elements and elastic surface include two sections with an opening between the two sections, wherein the support elements project at an acute to the pressing direction, with the support elements on opposite sides of the opening projecting away from other so that the elastic surface of one section is expandable in a direction away from the elastic surface of the other section in order to exert a stretching force onto an upper sheet of the printed product;

a trimming knife positioned to trim the side edge, the trimming knife operable to move between a starting position away from the trimming table and an ending position at the trimming table; and a counter blade or a cutting bar mounted to limit a cutting stroke of the trimming knife.

3. The device according to claim 2, further comprising a layer coupled to the elastic surface of the press die.

4. The device according to claim 2, wherein each support element includes an end that faces the printed product, wherein the end deflects in at least one expansion direction of the elastic surface.

5. The device according to claim 2, wherein the support elements comprise strips.

6. The device according to claim 5, wherein the support elements are adapted to be arranged on the printed product diagonal to side edges of the printed product, so as to be effective toward said side edges.

7. The device according to claim 5, wherein the support elements comprise a curved shape.

8. The device according to claim 2, wherein the elastic surface comprises a plate, the plate being elastically deformable at least in some sections of the plate.

9. A three-way trimmer comprising a device of claim 2 for trimming at least one side edge of a bound printed product.

10. A method of trimming at least one side edge of a bound printed product, comprising: utilizing the device of claim 2.

* * * * *